US010731593B2

(12) United States Patent
Surnilla et al.

(10) Patent No.: US 10,731,593 B2
(45) Date of Patent: Aug. 4, 2020

(54) METHOD AND SYSTEM FOR FUEL INJECTOR BALANCING

(71) Applicant: Ford Global Technologies, LLC, Dearborn, MI (US)

(72) Inventors: Gopichandra Surnilla, West Bloomfield, MI (US); Joseph Lyle Thomas, Holt, MI (US); Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/156,705

(22) Filed: Oct. 10, 2018

(65) Prior Publication Data

US 2020/0116099 A1 Apr. 16, 2020

(51) Int. Cl.
*F02D 41/38* (2006.01)

(52) U.S. Cl.
CPC .. *F02D 41/3863* (2013.01); *F02D 2200/0604* (2013.01); *F02D 2200/0611* (2013.01)

(58) Field of Classification Search
CPC ..... F02D 2200/0602; F02D 41/3809; F02D 41/3836; Y02T 10/44; F02M 63/0225
See application file for complete search history.

(56) References Cited

U.S. PATENT DOCUMENTS 5,535,621 A 7/1996 Glidewell et al.
6,102,009 A 8/2000 Nishiyama
6,694,953 B2 2/2004 Barnes et al.
7,523,743 B1 4/2009 Geveci et al.
7,788,015 B2 8/2010 Geveci et al.
7,900,605 B2 3/2011 Dingle
8,950,379 B2 2/2015 Hattar et al.
9,435,310 B2 9/2016 Moonjelly et al.
9,593,637 B2 3/2017 Surnilla et al.
2004/0011325 A1* 1/2004 Benson ..... F02D 41/22 123/299
2004/0134268 A1* 7/2004 Tuken ..... F02D 41/2496 73/114.39
2004/0154594 A1* 8/2004 Miyashita ..... F02D 33/003 123/458
2015/0240739 A1* 8/2015 Pursifull ..... F02D 41/008 123/445
2017/0051700 A1* 2/2017 Fulton ..... F02D 41/1497
2018/0306134 A1* 10/2018 Uhrich ..... F02D 41/0087
2018/0334985 A1* 11/2018 Stenl ..... F02B 75/18

FOREIGN PATENT DOCUMENTS

CN 105003372 A 10/2015

* cited by examiner

*Primary Examiner* — Sizo B Vilakazi

(74) *Attorney, Agent, or Firm* — Geoffrey Brumbaugh; McCoy Russell LLP

(57) ABSTRACT

Methods and systems are provided for improved injector balancing. In one example, fuel rail pressure samples collected during a noisy zone of injector operation are discarded while samples collected during a quiet zone are averaged to determine an injector pressure. The injector pressure is then used to infer injection volume, injector error, and update an injector transfer function.

20 Claims, 5 Drawing Sheets

METHOD AND SYSTEM FOR FUEL INJECTOR BALANCING

FIELD

The present description relates generally to methods and systems for calibrating a fuel injector of an engine so as to balance fuel delivery between all engine fuel injectors.

BACKGROUND/SUMMARY

Engines may be configured with direct fuel injectors (DI) for injecting fuel directly into an engine cylinder and/or port fuel injectors (PFI) for injecting fuel into an intake port of an engine cylinder. Fuel injectors often have piece-to-piece and variability over time due to imperfect manufacturing processes and/or injector aging, for example. Over time, injector performance may degrade (e.g., injector becomes clogged) which may further increase piece-to-piece injector variability. As a result, the actual amount of fuel injected to each cylinder of an engine may not be the desired amount and the difference between the actual and desired amounts may vary between injectors. Variability in fuel injection amount between cylinders can result in reduced fuel economy, increased tailpipe emissions, torque variation that causes a lack of perceived engine smoothness, and an overall decrease in engine efficiency. Engines operating with a dual injector system, such as dual fuel or PFDI systems, may have even more fuel injectors (e.g., twice as many) resulting in greater possibility for injector variability.

Various approaches estimate injector performance by correlating a pressure drop across a fuel rail coupled to an injector with a fuel mass injected by the corresponding injector. One example approach is shown by Surnilla et al. in U.S. Pat. No. 9,593,637. Therein, a fuel injection amount for an injector is determined based on a difference in fuel rail pressure (FRP) measured before injector firing and FRP after injector firing. Another example approach is shown by Geveci et al. in U.S. Pat. No. 7,523,743. Therein, rail pressure sensor inputs and engine speed sensor inputs are used to determine multiple pressure values at each tooth position over a single engine cycle. An average or mean of the multiple pressure values is then used to infer injector leakage.

However, the inventors herein have recognized potential issues with such systems. As one example, there may be data errors in sampling the fuel rail pressure due to pressure ringing in the fuel making for aliasing errors. In particular, pressure may ring in the fuel rail for a duration during and following a fuel injection event. Given an inward-opening fuel injector, when the pintle moves inward, it compresses the fluid behind the injector, raising the fuel pressure. When fluid begins to exit the injector, the pressure drops (due to effective bulk modulus). When the pintle closes, its abrupt closing triggers a pressure oscillation (water hammer) that decays exponentially. Sampling in the presence of noise causes variation on a signal that one expects to represent a mean value. When this signal noise has a strong particular frequency content, the resulting sampled signal, even when averaged, could vary significantly from a mean value. A sampled signal of an oscillating signal may appear to be a shifted DC level or an AC signal of a different frequency than either the signal or the sample rate. Hence, it is referred to as an aliased signal, appearing to be something it is not. In addition to aliasing errors, there may be errors due to electrical or pressure noise. Pressure or electrical noise is largely expected to be uncorrelated to the sample rate and thus tends to reduce with averaging. Further still, data errors may be caused due to a finite analog to digital (AtoD) resolution. AtoD converters can only detect discrete voltage levels, not a truly continuous circuit. Since the actual fuel mass (or volume) injected is determined as a function of the fuel pressure drop, even small errors in fuel pressure sampling can translate into large fuel mass errors, resulting in incorrect injector compensation.

In one example, the issues described above may be addressed by a method for an engine comprising: for an injection event, averaging fuel rail pressure sampled after a delay since an end of injector closing; learning an injector fuel mass error for each engine injector based on the averaged fuel rail pressure; and adjusting subsequent engine fueling based on the learned injector error. In this way, fuel rail pressure changes corresponding to a fuel injection event can be determined more reliably, allowing for improved injector balancing.

As one example, during engine fueling, fuel rail pressure may be sampled over the course of a number of injection events. Fuel rail pressure (FRP) may be sampled at a defined sampling rate which may be synchronous or asynchronous with engine events. Each sample may include a fuel rail pressure estimate and an associated engine angle/position. Samples collected during an injection event (for a given injector) may be discarded. In addition, samples collected for a calibrated threshold duration (e.g., 5 msec) after the injection ends may be discarded. Samples collected on both PIP edges are then buffered. Specifically, the same samples collected after the threshold duration and before the start of the subsequent injection event are averaged. This corresponds to an average pressure for the given injection event. By comparing this average pressure to a similarly calculated average pressure for an immediately preceding injection event, a pressure difference may be determined. An actual fuel injection volume corresponding to the pressure difference is then calculated. By comparing the actual injection volume to a commanded injection volume for the given injection event, an error for the corresponding fuel injector may be determined. By similarly determining injector errors for all engine fuel injectors, and comparing the corresponding errors for all the injectors, fueling may be adjusted so that all injectors have the same error, thereby balancing the injectors.

In this way, fuel rail pressures sampled for a defined duration after a fuel injector has closed on an injection event are discarded. The technical effect of discarding samples in a noisy region of the sensor signal is that injector aliasing errors caused by pressure values sampled during a decay of pressure ringing can be removed. By only averaging fuel rail pressures sampled over quiet period of the fuel injection, (e.g., only between and the decay of the pressure ringing and the beginning of the next injection event), resolution errors are also reduced. As a result, fuel rail pressures and corresponding fuel injection volumes for fuel injectors can be estimated more accurately and reliably. This allows for improved injector balancing.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
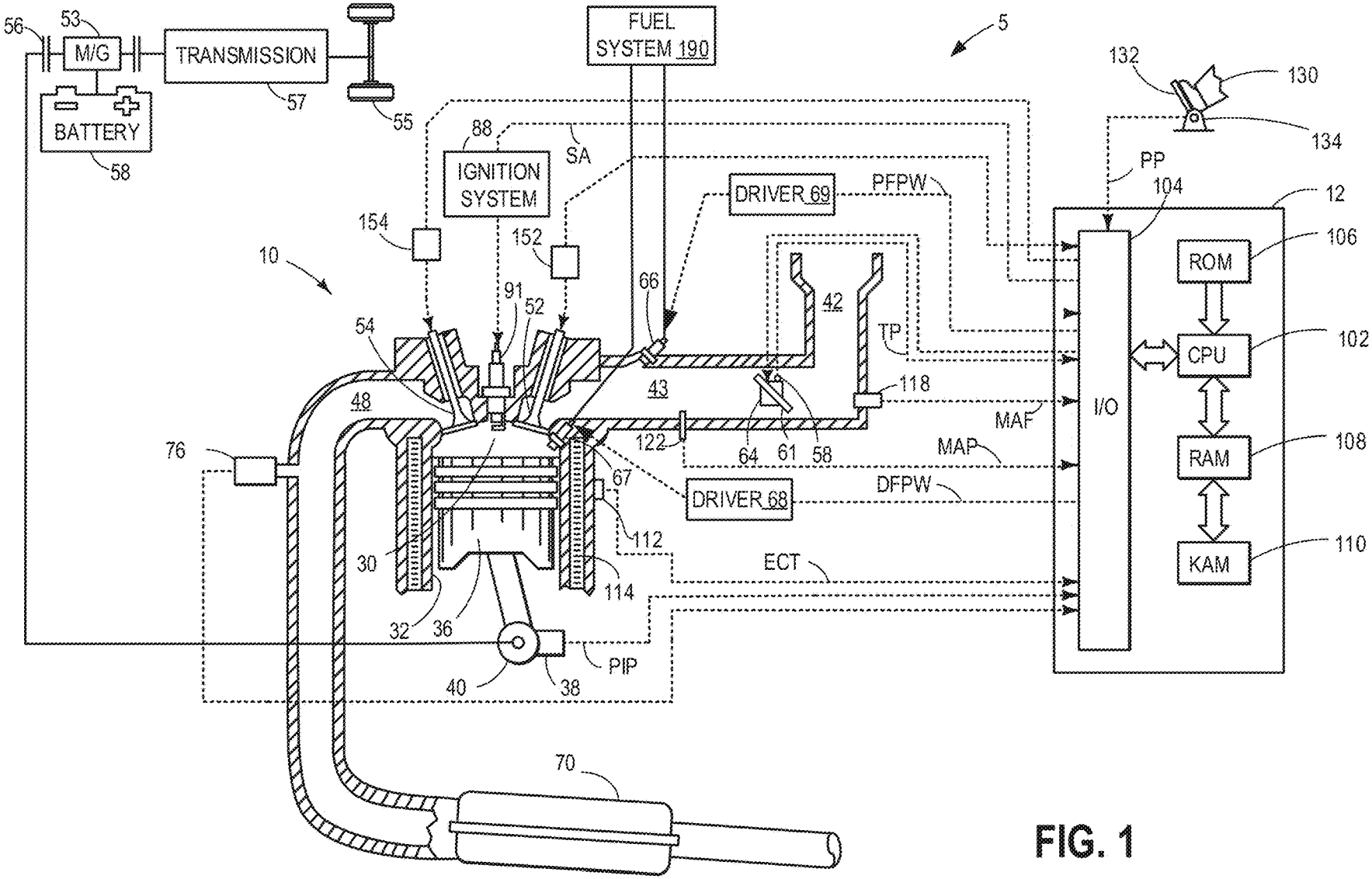
FIG. 1 shows a schematic depiction of an example engine system.

The following description relates to systems and methods for calibrating fuel injectors in an engine, such as the engine system of FIG. 1. The fuel injectors may be direct and/or port fuel injectors. A controller may be configured to sample fuel rail pressure at a predefined sampling rate during fueled engine operation. The controller may then perform a control routine, such as the example routine of FIG. 2, to learn an average fuel rail pressure for each injection event by correlating changes in fuel rail pressure at each injection event with a volume of injection (FIG. 3). In particular, estimation errors are reduced by discarding samples collected during the injection, as well as for a period following the injection where pressure ringing can confound pressure estimation. By averaging the remaining samples, a more accurate representation of the change in fuel rail pressure is provided, allowing for improved fuel injector balancing.

FIG. 1 shows a schematic depiction of a spark ignition internal combustion engine 10 with a dual injector system, where engine 10 is configured with both direct and port fuel injection. Engine 10 may be included in a vehicle 5. Engine 10 comprises a plurality of cylinders of which one cylinder 30 (also known as combustion chamber 30) is shown in FIG. 1. Cylinder 30 of engine 10 is shown including combustion chamber walls 32 with piston 36 positioned therein and connected to crankshaft 40. A starter motor (not shown) may be coupled to crankshaft 40 via a flywheel (not shown), or alternatively, direct engine starting may be used.

Combustion chamber 30 is shown communicating with intake manifold 43 and exhaust manifold 48 via intake valve 52 and exhaust valve 54, respectively. In addition, intake manifold 43 is shown with throttle 64 which adjusts a position of throttle plate 61 to control airflow from intake passage 42.

Intake valve 52 may be operated by controller 12 via actuator 152. Similarly, exhaust valve 54 may be activated by controller 12 via actuator 154. During some conditions, controller 12 may vary the signals provided to actuators 152 and 154 to control the opening and closing of the respective intake and exhaust valves. The position of intake valve 52 and exhaust valve 54 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 30 may alternatively include an intake valve controlled via electric valve actuation and an exhaust valve controlled via cam actuation including CPS and/or VCT. In other embodiments, the intake and exhaust valves may be controlled by a common valve actuator or actuation system, or a variable valve timing actuator or actuation system.

In another embodiment, four valves per cylinder may be used. In still another example, two intake valves and one exhaust valve per cylinder may be used.

Combustion chamber 30 can have a compression ratio, which is the ratio of volumes when piston 36 is at bottom center to top center. In one example, the compression ratio may be approximately 9:1. However, in some examples where different fuels are used, the compression ratio may be increased. For example, it may be between 10:1 and 11:1 or 11:1 and 12:1, or greater.

In some embodiments, each cylinder of engine 10 may be configured with one or more fuel injectors for providing fuel thereto. As shown in FIG. 1, cylinder 30 includes two fuel injectors, 66 and 67. Fuel injector 67 is shown directly coupled to combustion chamber 30 for delivering injected fuel directly therein in proportion to the pulse width of signal DFPW received from controller 12 via electronic driver 68. In this manner, direct fuel injector 67 provides what is known as direct injection (hereafter referred to as "DI") of fuel into combustion chamber 30. While FIG. 1 shows injector 67 as a side injector, it may also be located overhead of the piston, such as near the position of spark plug 91. Such a position may improve mixing and combustion due to the lower volatility of some alcohol based fuels. Alternatively, the injector may be located overhead and near the intake valve to improve mixing.

Fuel injector 66 is shown arranged in intake manifold 43 in a configuration that provides what is known as port injection of fuel (hereafter referred to as "PFI") into the intake port upstream of cylinder 30 rather than directly into cylinder 30. Port fuel injector 66 delivers injected fuel in proportion to the pulse width of signal PFPW received from controller 12 via electronic driver 69.

Fuel may be delivered to fuel injectors 66 and 67 by a high pressure fuel system 190 including a fuel tank, fuel pumps, and fuel rails. Further, the fuel tank and rails may each have a pressure transducer providing a signal to controller 12.

Injectors may have injector-to-injector variability due to manufacturing, as well as due to age. Ideally, for improved fuel economy, it is desired for every cylinder to have matching fuel injection amounts for matching fuel delivery commands. By balancing air and fuel injection into all cylinders, engine performance is improved. However, due to injector variability, wherein each injector has a different error between what is commanded to be dispensed and what is actually dispensed, there may be engine performance issues. As such, fuel injector (not air) balancing may result in an engine's torque evenness. Air and fuel evenness improves emission control. While a pressure drop across the injector can be used to learn a fuel injection volume, and balance injector operations, even small errors in pressure estimation can result in large errors in fuel mass estimation. Adjustments based on the incorrect fuel mass estimates can aggravate injector variability. When an injector is closed at the end of an injection event, the closing of the pintle can result in a vibration that causes pressure oscillations or ringing. While the oscillations decay over time, if a fuel rail pressure is sampled while the pressure is oscillating, the actual pressure may be over or under estimated, based on which region of the oscillation the pressure is sampled in. To reduce these errors, as elaborated with reference to FIG. 2, a larger number of fuel rail pressure samples are collected during an injector fueling event. Then, a subset of the samples collected in a noisy region of the injector, where pressure samples during large pressure oscillations can skew the pressure estimates, are discarded. Further, a remaining subset of the samples collected in a quiet region of the injector are averaged. This allows for noise errors to be reduced, improving injector error learning, and error compensation for improved injector balancing. For example, the error for each injector may be learned as a function of the average rail pressure estimated via the subset of samples. Then, the fuel pulse commanded to each fuel injector may be adjusted so as to provide a common error on each injector, thereby balancing the injectors.

Returning to FIG. 1, exhaust gases flow through exhaust manifold 48 into emission control device 70 which can include multiple catalyst bricks, in one example. In another example, multiple emission control devices, each with multiple bricks, can be used. Emission control device 70 can be a three-way type catalyst in one example.

Exhaust gas sensor 76 is shown coupled to exhaust manifold 48 upstream of emission control device 70 (where sensor 76 can correspond to a variety of different sensors). For example, sensor 76 may be any of many known sensors for providing an indication of exhaust gas air/fuel ratio such as a linear oxygen sensor, a UEGO, a two-state oxygen sensor, an EGO, a HEGO, or an HC or CO sensor. In this particular example, sensor 76 is a two-state oxygen sensor that provides signal EGO to controller 12 which converts signal EGO into two-state signal EGOS. A high voltage state of signal EGOS indicates exhaust gases are rich of stoichiometry and a low voltage state of signal EGOS indicates exhaust gases are lean of stoichiometry. Signal EGOS may be used to advantage during feedback air/fuel control to maintain average air/fuel at stoichiometry during a stoichiometric homogeneous mode of operation. A single exhaust gas sensor may serve 1, 2, 3, 4, 5, or other number of cylinders.

Distributorless ignition system 88 provides ignition spark to combustion chamber 30 via spark plug 91 in response to spark advance signal SA from controller 12.

Controller 12 may cause combustion chamber 30 to operate in a variety of combustion modes, including a homogeneous air/fuel mode and a stratified air/fuel mode by controlling injection timing, injection amounts, spray patterns, etc. Further, combined stratified and homogenous mixtures may be formed in the chamber. In one example, stratified layers may be formed by operating injector 66 during a compression stroke. In another example, a homogenous mixture may be formed by operating one or both of injectors 66 and 67 during an intake stroke (which may be open valve injection). In yet another example, a homogenous mixture may be formed by operating one or both of injectors 66 and 67 before an intake stroke (which may be closed valve injection). In still other examples, multiple injections from one or both of injectors 66 and 67 may be used during one or more strokes (e.g., intake, compression, exhaust, etc.). Even further examples may be where different injection timings and mixture formations are used under different conditions, as described below.

Controller 12 can control the amount of fuel delivered by fuel injectors 66 and 67 so that the homogeneous, stratified, or combined homogenous/stratified air/fuel mixture in chamber 30 can be selected to be at stoichiometry, a value rich of stoichiometry, or a value lean of stoichiometry.

As described above, FIG. 1 merely shows one cylinder of a multi-cylinder engine, and that each cylinder has its own set of intake/exhaust valves, fuel injectors, spark plugs, etc. Also, in the example embodiments described herein, the engine may be coupled to a starter motor (not shown) for starting the engine. The starter motor may be powered when the driver turns a key in the ignition switch on the steering column, for example. The starter is disengaged after engine start, for example, by engine 10 reaching a predetermined speed after a predetermined time. Further, in the disclosed embodiments, an exhaust gas recirculation (EGR) system may be used to route a desired portion of exhaust gas from exhaust manifold 48 to intake manifold 43 via an EGR valve (not shown). Alternatively, a portion of combustion gases may be retained in the combustion chambers by controlling exhaust valve timing.

In some examples, vehicle 5 may be a hybrid vehicle with multiple sources of torque available to one or more vehicle wheels 55. In other examples, vehicle 5 is a conventional vehicle with only an engine, or an electric vehicle with only electric machine(s). In the example shown, vehicle 5 includes engine 10 and an electric machine 53. Electric machine 53 may be a motor or a motor/generator. Crankshaft 140 of engine 10 and electric machine 53 are connected via a transmission 57 to vehicle wheels 55 when one or more clutches 56 are engaged. In the depicted example, a first clutch 56 is provided between crankshaft 140 and electric machine 53, and a second clutch 56 is provided between electric machine 53 and transmission 57. Controller 12 may send a signal to an actuator of each clutch 56 to engage or disengage the clutch, so as to connect or disconnect crankshaft 140 from electric machine 53 and the components connected thereto, and/or connect or disconnect electric machine 53 from transmission 57 and the components connected thereto. Transmission 54 may be a gearbox, a planetary gear system, or another type of transmission. The powertrain may be configured in various manners including as a parallel, a series, or a series-parallel hybrid vehicle.

Electric machine 53 receives electrical power from a traction battery 58 to provide torque to vehicle wheels 55. Electric machine 53 may also be operated as a generator to provide electrical power to charge battery 58, for example during a braking operation.

Controller 12 is shown in FIG. 1 as a conventional microcomputer including: central processing unit (CPU) 102, input/output (I/O) ports 104, read-only memory (ROM) 106, random access memory (RAM) 108, keep alive memory (KAM) 110, and a conventional data bus. Controller 12 is shown receiving various signals from sensors coupled to engine 10, in addition to those signals previously discussed, including measurement of inducted mass air flow (MAF) from mass air flow sensor 118; engine coolant temperature (ECT) from temperature sensor 112 coupled to cooling sleeve 114; a profile ignition pickup signal (PIP) from Hall effect sensor 38 coupled to crankshaft 40; and throttle position TP from throttle position sensor 58 and an absolute Manifold Pressure Signal MAP from sensor 122. Engine speed signal RPM is generated by controller 12 from signal PIP in a conventional manner and manifold pressure signal MAP from a manifold pressure sensor provides an indication of vacuum, or pressure, in the intake manifold. During stoichiometric operation, this sensor can give an indication of engine load. Further, this sensor, along with engine speed, can provide an estimate of charge (including air) inducted into the cylinder. In one example, sensor 38, which is also used as an engine speed sensor, produces a predetermined number of equally spaced pulses every revolution of the crankshaft. The controller 12 receives signals from the various sensors of FIG. 1 and employs the various actuators of FIG. 1, such as throttle 61, fuel injectors 66 and 67, spark plug 91, etc., to adjust engine operation based on the received signals and instructions stored on a memory of the controller. As one example, the controller may send a pulse width signal to the port injector and/or the direct injector to adjust an amount of fuel delivered to a cylinder.

In this way, the components of FIG. 1 enables a system comprising: a first fuel injector for delivering fuel from a fuel rail to a first cylinder; a second fuel injector for delivering fuel from the fuel rail to a second cylinder; a third fuel injector for delivering fuel from the fuel rail to a third cylinder; a pressure sensor coupled to the fuel rail; and a controller with computer-readable instructions that when executed cause the controller to: sample fuel rail pressure at a frequency on a first injection event from first injector opening to second injector opening, and on a second injection event from the start of second injector opening to the start of third injector opening; estimate a first average injection pressure for the first injection event by averaging the fuel rail pressure sampled from a delay since first injector closing to the second injector opening; estimate a second average injection pressure for the second injection event by averaging the fuel rail pressure sampled from a delay since second injector closing to the third injector opening; learn second injector error based on a difference between the first and second average injection pressure; and adjust a transfer function of the second injector based on the learned second injector error. Additionally or optionally, fuel rail pressure sampled from first injector opening to the delay since first injector closing is not included in the averaging for the first injection event, and the fuel rail pressure sampled from second injector opening to the delay since second injector closing is not included in the averaging for the second injection event. The controller may include further instructions to estimate an average injector error based on the learned second injector error and adjust the transfer function of the first and third injector based on the average injector error. Further, each of the first, second, and third injector may be a direct fuel injector. A transfer function may be adjusted to provide a common injector error for each of the first, second, and third injector.

Figure 2:
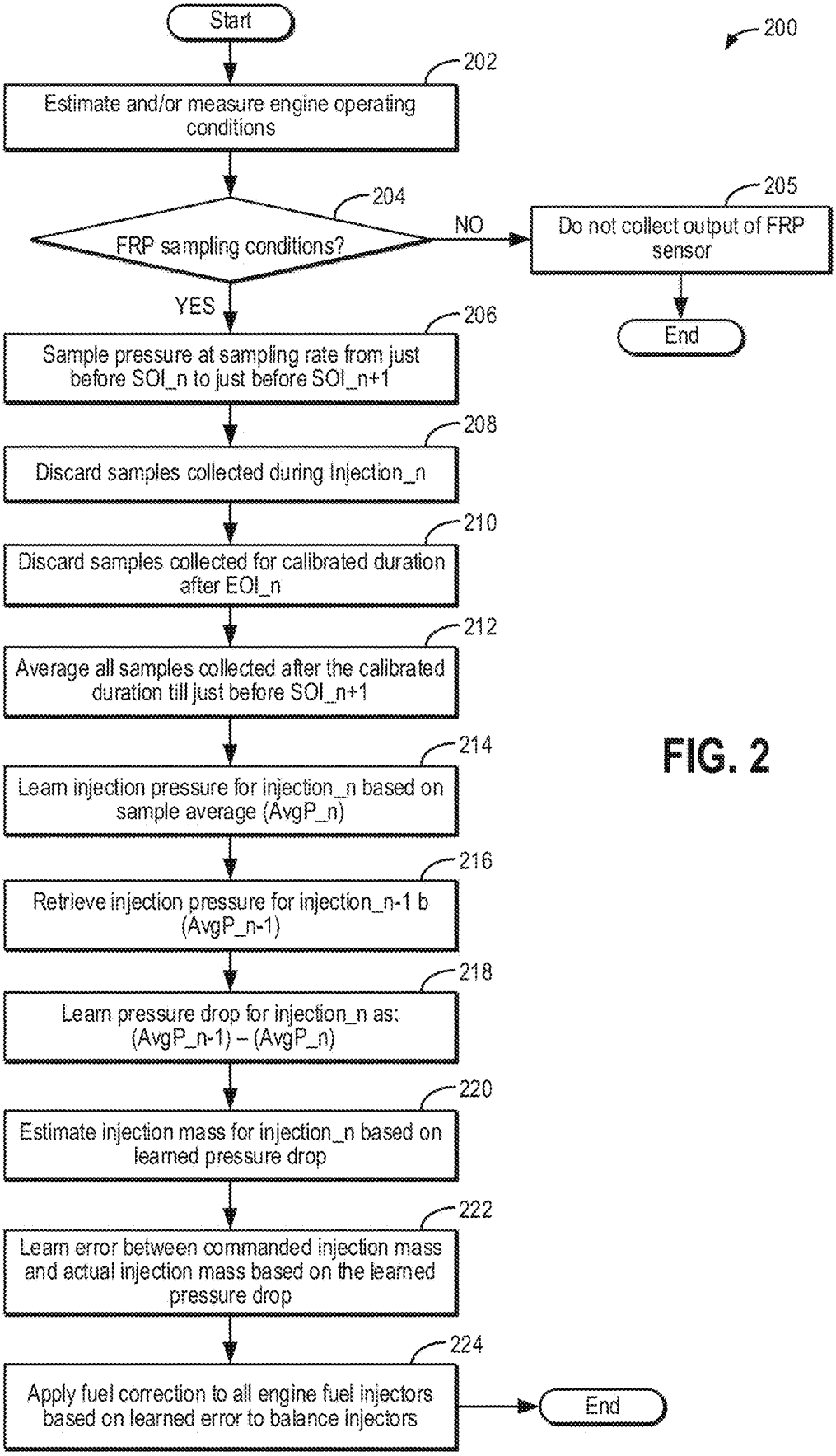
FIG. 2 shows a high level flow chart of an example method for learning an injection volume of an injection event based on sampled fuel rail pressure.
Figure 3:
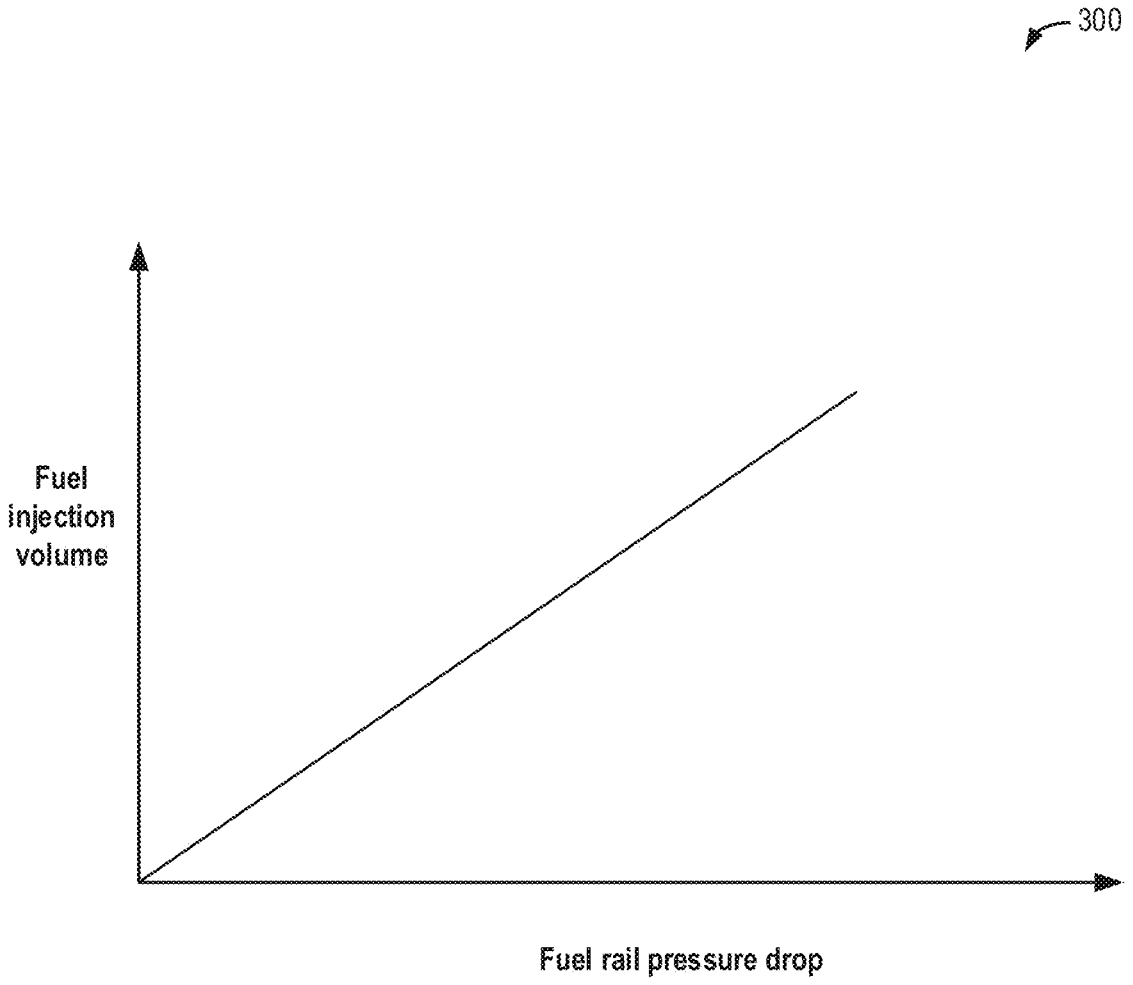
FIG. 3 depicts a graphical relationship between a fuel rail pressure drop and injected fuel quantity at a fuel injection system.

Turning now to FIG. 2, an example method for estimating a fuel injection volume dispensed by a fuel injector on a given fuel injection event is shown at 200. By estimating the fuel volume for each cylinder fuel injector over an engine cycle, and comparing the estimates, cylinder injector balancing may be provided to improve engine performance. The method enables a change in fuel rail pressure following an injection event to be more accurately determined, with fewer aliasing errors, thereby enabling a more reliable estimation of fuel injection volume. Instructions for carrying out method 200 may be executed by a controller based on instructions stored on a memory of the controller and in conjunction with signals received from sensors of the engine system, such as the sensors described above with reference to FIG. 1. The controller may employ engine actuators of the engine system to adjust engine operation, according to the methods described below.

At 202, the method includes estimating and/or measuring engine operating conditions. These include, for example, engine speed, torque demand, manifold pressure, manifold air flow, ambient conditions (ambient temperature, pressure, and humidity, for example), engine dilution, etc.

At 204, it may be determined if fuel rail pressure (FRP) sampling conditions are met. In one example, FRP sampling conditions are met if the engine is operating fueled with fuel being delivered to engine cylinders via a port or a direct fuel injector. For example, any time the direct injectors are in use, they can be sampled and balanced for that condition. While the sampling conditions are defined as a function of fuel injection pulse width and FRP, it will be appreciated that other variables could be chosen. If FRP sampling conditions are not met, then at 205, the method includes not collecting the output of a fuel rail pressure sensor coupled to a direct and/or a port injection fuel rail. The method then ends.

If FRP sampling conditions are met, then at 206, the method includes sampling fuel rail pressure at a defined sampling rate from just before a timing of the start of injection of a given injection event (e.g., from before SOI_n where n is the injection event number) to just before the start of injection of an immediately subsequent injection event (SOI_n+1). Herein, the fuel rail pressure sampled includes a port injection fuel rail pressure when the injection event is a port injection event, and a direct injection fuel rail pressure when the injection event is a direct injection event. In one example, fuel rail pressure is sampled at a 1 kHz frequency. For example, the fuel rail pressure may be sampled at a low data rate of once every 1 millisecond period (that is, a 1 millisecond period, 12 bit pressure sample). In still other examples, the fuel rail pressure may be sampled at a high speed, such as a 10 kHz (that is, a 0.1 millisecond period, 14 bit pressure sample), however the higher sampling rate may not be economical. As a result of the sampling, a plurality of pressure samples are collected for each injection event. Herein, each injection event is defined as a period starting from just before injector opening, and ending just before the opening of another injector on a subsequent injection event. The pressure signal may improve as the number of firing cylinders decreases.

At 208, the method includes discarding samples collected during the injection. Specifically, samples collected over a duration of injector opening are discarded. This includes samples collected from just before SOI of injection n (that is a timing when the injector starts to open to deliver fuel) to end of injection (EOI) of injection n (that is a timing when the injector has completely closed after having delivered the commanded fuel amount).

At 210, the method includes discarding samples collected for a threshold duration following the EOI_n. The threshold duration may be a calibrated duration selected based on the sampling frequency and the fuel rail pressure. The sampling frequency influences the decision, but for a given system, the damping is constant no matter what the FRP is. One example threshold duration is 5 msec. If more damping geometries are present, the threshold duration may be smaller. A single sensor serving an 8-cylinder engine at 1200 rpm ends up with injections 12.5 msec apart. In one example, where the sampling frequency is once every 1 msec, the threshold duration is 5 msecs. Herein, the threshold duration is calibrated to correspond to a duration over which the fuel rail pressure ringing decays. As such, closure of a pintle of a fuel injector at the EOI timing results in a vibration that causes the fuel rail pressure to oscillate or "ring". The oscillation gradually dampens down, however, if the oscillating fuel rail pressure is taken into account in estimating the average fuel rail pressure over an injection event, the actual fuel rail pressure may be overestimated, resulting in aliasing errors. This may in turn affect the fuel mass that is estimated to have been dispensed by the injector. To reduce these aliasing errors, the FRP samples collected in the noisy zone (that is, zone where pressure is still ringing) are discarded and only the samples collected in the quiet zone (that is, zone where the pressure is not ringing) are used in fuel mass estimation.

At 212, the method includes averaging all the samples collected in the quiet zone (AvgP_n). These include all samples collected after the calibrated duration (since EOI_n_ has elapsed till just before the start of the immediately subsequent injection event (SOC n+1). Averaging may include estimating a mean value of the selected samples. Alternatively, another statistical value, such as the median, mode, or weighted average of the selected samples may be determined. Further still, the samples may be processed via a filter. By averaging the samples collected in the quiet zone, measurement noise is further reduced, improving the reliability of the pressure estimation. At 214, the method includes learning the injection pressure for the completed injection event (n) as the average pressure AvgP_n.

At 216, the method includes retrieving the injection pressure for an immediately preceding injection event, that is, AvgP_n−1. The average pressure for injection event n−1 may have been similarly learned by sampling fuel rail pressures from before injection event n−1 to just before injection event n, discarding samples collected during the injection and for a threshold duration after the injection, and then averaging the remaining samples.

At 218, the method includes learning a pressure drop associated with injection n based on the average pressure of injection n relative to the average pressure of injection n−1. For example, the pressure drop (herein also referred to as DeltaP) may be learned as (AvgP_n−1)−(AvgP_n). At 220, the method includes estimating the fuel mass dispensed at injection n based on the learned pressure drop. In one example, a map correlating pressure drop with injection mass, such as map 300 of FIG. 3, may be used for estimating the dispensed fuel mass. In the depicted example, there is a linear relation between drop in fuel rail pressure over an injection event relative to the fuel mass dispensed by an injector on that injection event. In other examples, a model, transfer function, look-up table, or algorithm may be used to learn the dispensed fuel mass based on the pressure drop. The actual mass injected is further based on the bulk modulus of the fuel, the fuel density, and the fuel rail volume. In one example, the actual mass injected is determined as:

$$\text{Actual mass injected}=(\text{DeltaP}/\text{bulk modulus})*\text{fuel rail volume}*\text{fuel density}$$

At 222, the method includes computing an injector error between the intended (or commanded) injection mass and the actual injection mass as computed from the pressure difference. The computer difference in mass is the injector error that needs to be corrected in future injections to balance injectors. Specifically, a fuel mass error for the given injector is computed as a difference between the commanded fuel mass (determined based on commanded pulse-width) and the actual fuel mass (determined based on the measured delta pressure). The fuel mass error for the given injector is then compared to the corresponding fuel mass error for other cylinders, or an average fuel mass error for all engine cylinder injectors. For example, the fuel mass error for a first port or direct fuel injector via which fuel is dispensed into a first cylinder during injection_n is compared to a fuel mass error for corresponding port or direct fuel injectors via which fuel is dispensed into each of the remaining engine cylinders over a single engine cycle (where each cylinder is fueled once over the cycle). Based on the differences in fuel mass error between the injectors, a degree of balancing required between injectors is determined. The corrections across all injectors are computed, averaged, and then the average is subtracted from the individual injector corrections to learn the remaining injector-to-injector corrections needed to balance the injectors without affecting the average fueling across the cylinders. In this way, the relative errors between fuel injectors is learned and corrected for.

At 224, the method includes applying a fuel correction to at least the fuel injector that dispensed injection n based on the learned error to balance errors between injectors. More particularly, a fuel correction is applied to all engine fuel injectors so that all injectors have a common average error. For example, a transfer function of each fuel injector may be updated based on the learned fuel mass error for each injector and an average fuel injector error to reduce the variability in fuel mass injected by each injector for a given pulse width command. The method then ends.

It will be appreciated that the errors are not corrected in one single measurement as there may be noise in the measurement. Thus, the controller aims to correct the average error, instead of trying to respond to the system noise. In one example, this is done by making a percent of the requisite correction at each pass, e.g. 20% on the first pass and then taking another delta P measurement and making another 20% correction on the second pass, and so on. In this way, the corrections will result in the average error converging toward zero.

For example, if the controller commanded an injection of 8.000 mg to injector_n, and from the delta FRP of injector_n, an actual injection mass of 8.200 mg was determined, then the controller may learn that the given fuel injector over-fueled by 0.200 mg. To balance the errors for all injectors, a similar error is determined for each injector and averaged. The 0.200 mg error of injector_n is compared to the average error. For example, if the average error is computed to be 0.180 mg, then the fueling of each injector is adjusted to bring the injector error (for each injector error) to the average error. In this case, the command to injector_n is adjusted to account for a 0.020 mg surplus. As such, adjusting the injector error to balance the injectors is different from adjusting the error to correct for it. To correct for the error, the injector command would have been adjusted to account for a 0.200 mg surplus.

As an example of selecting specific subset of samples for average FRP estimation, a cylinder of an engine (say cylinder #1) receives a single fuel injection per cylinder event. The commanded fuel mass in 0.05 g. The rail pressure is 1.425 MPa. The inferred bulk modulus is 800 kPa. The density of the fuel is 0.75. Injection is started (SOI) in the cylinder at 56° and injection ends (EOI) at 79°. FRP samples that are averaged are started at EOI+5 milliseconds, and ended at SOI of the next cylinder. Pressure before SOI is measured by averaging 1 to 32 one millisecond samples immediately before SOI over one PIP period. A full PIP period is 36 milliseconds. By rejecting samples between SOI and and EOI+5 milliseconds, a mean FRP is determined to be 1.234 MPa. A similarly determined mean FRP for an immediately previous injection event in a cylinder firing immediately previous to cylinder #1 is 1.425. MPa. The delta P then 1.425−1.234=0.191 MPa. The actual fuel mass and injector mass error is then determined based on this delta P estimate. As such, if the noisy zone were also included, the mean FRP would have been in error by as much as ±100%.

It will be appreciated that the pressure drop measurement is performed per injection event with a single injection per cylinder event. In cylinders where there are multiple injections per cylinder event, the routine may be updated. By accounting for the injection overlap, the pressure estimation can be performed reliably while using a single pressure sensor. In addition, accommodations may be made for more complex situations such as pump strokes coincident with injections and injections that are coincident with each other. As used herein, "accounting" for to various complex situations includes carefully counting the physical processes that tend to change the pressure. Pump strokes raise the pressure. Injections lower the pressure. Temperature rise raises pressure, albeit slowly. At slower engine speeds and lower loads, injectors do not overlap so that adaptive corrections can be limited to that condition.

In this way, at a low engine speed, multiple pressure samples (e.g., 20 or more) may be collected in the pressure signal's quiet zone. By sampling and averaging multiple samples, error due to pressure/electrical noise and error due to AtoD resolution is reduced. It will be appreciated that while the method of FIG. 2 discusses using the FRP sampling for injector balancing, it may be similarly applicable to all FRP sampling to increase the FRP accuracy. For example, the method may be used to reliably estimate FRP for feedback pressure control and for computing an injector pulse-width. As a result, the contribution of injector pressure noise on FRP error is reduced.

As such, the current approach provides various advantages over other methods. For example, exhaust gas based methods are not as reliable because it is not known if the cylinder air is distributed evenly. There are injector balance methods that use the electrical current signal from the injector, but they only work on correcting opening time variation. In comparison, the current delta pressure method works over both the ballistic zone and the fully open zone.

Figure 4:
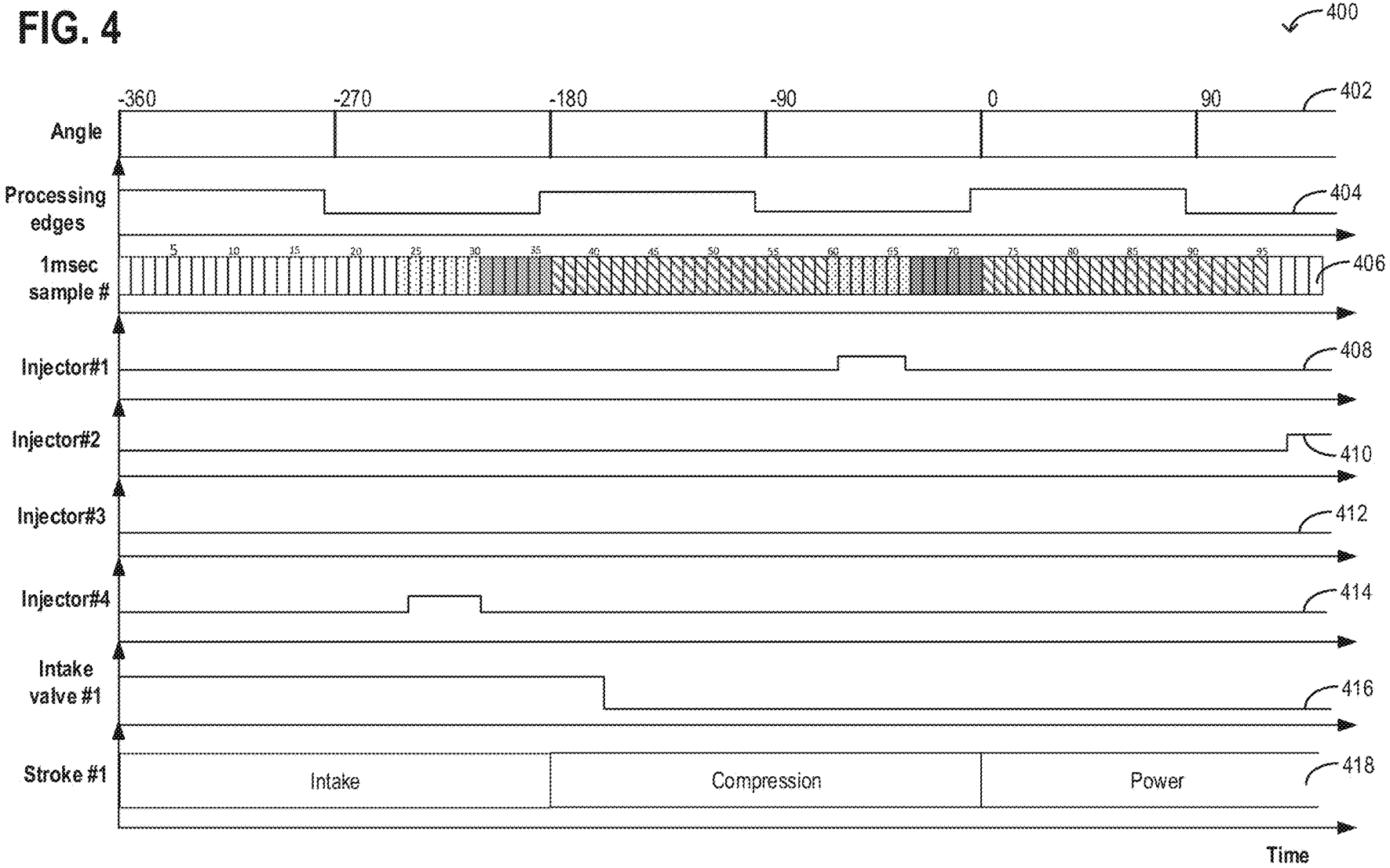
FIG. 4 depicts an example time/angle segment of an injection event over which a portion of fuel rail pressure samples are rejected, and another portion of fuel rail samples are averaged for injection volume estimation.

FIG. 4 shows one example a selection of FRP samples for injection pressure and fuel mass estimation. Map 400 depicts processing edges of a PIP sensor at plot 404 and the corresponding engine position in terms of crank angle degree at plot 402. Samples are collected at 1 msec intervals, as shown at plot 406, with each rectangle/box corresponding to a single sample. The operation of each of 4 injectors coupled to 4 different cylinders (labeled 1-4) of an engine is shown at plots 408-414. In the present example, the order of firing is 1-3-2-4. The operation of an intake valve of cylinder #1 is shown at plot 416. The corresponding stroke for cylinder #1 is shown at plot 418.

The example illustrates the estimation of a fuel rail pressure and corresponding fuel mass for an injector in cylinder #1 (herein referred to as injector #1). In the depicted example, cylinder #4 has fired before cylinder #1. The fuel injector of cylinder #4 (herein referred to as injector #4) is opened for a duration after −270 CAD. FRP samples collected during the opening of injector #4 are discarded, as shown by dotted rectangles corresponding to samples 24-30. Samples collected for a threshold duration after the end of the injection are also discarded. These are samples 31-36, collected during the noisy zone of the injector, and shown by filled rectangles. FRP samples collected after the threshold duration and before the start of the next injection in cylinder #1 are kept and averaged. These are the samples for injector #4 collected during the quiet zone and correspond to samples 37-59, as shown by hatched rectangles. An average pressure for injector #4 is estimated based on samples 37-59 only. The fuel injector of cylinder #1 is subsequently opened for a duration after −90 CAD. FRP samples collected during the opening of injector #1 are discarded, as shown by dotted rectangles corresponding to samples 60-66. Samples collected for a threshold duration after the end of the injection are also discarded. These are samples 67-72, collected during the noisy zone of the injector, and shown by filled rectangles. FRP samples collected after the threshold duration and before the start of the next injection in cylinder #3 are kept and averaged. These are the samples for injector #1 collected during the quiet zone and correspond to samples 73-95, as shown by hatched rectangles. An average pressure for injector #1 is estimated based on samples 73-95 only. By comparing the average pressure for injector #1 with the average pressure for injector #4, a pressure drop at injector #1 during the injection event can be determined and used to estimate the injected fuel mass. The inventors have recognized that the operation of intake valves do not determine how much fuel is released by an injector based on a pressure measurement before and after. The only thing that affects the fuel pressure in the fuel rail is how much fuel went in (via a pump), how much fuel went out (via an injector), and temperature rise (which is slow relative to short-acting pump strokes and injections.

Figure 5:
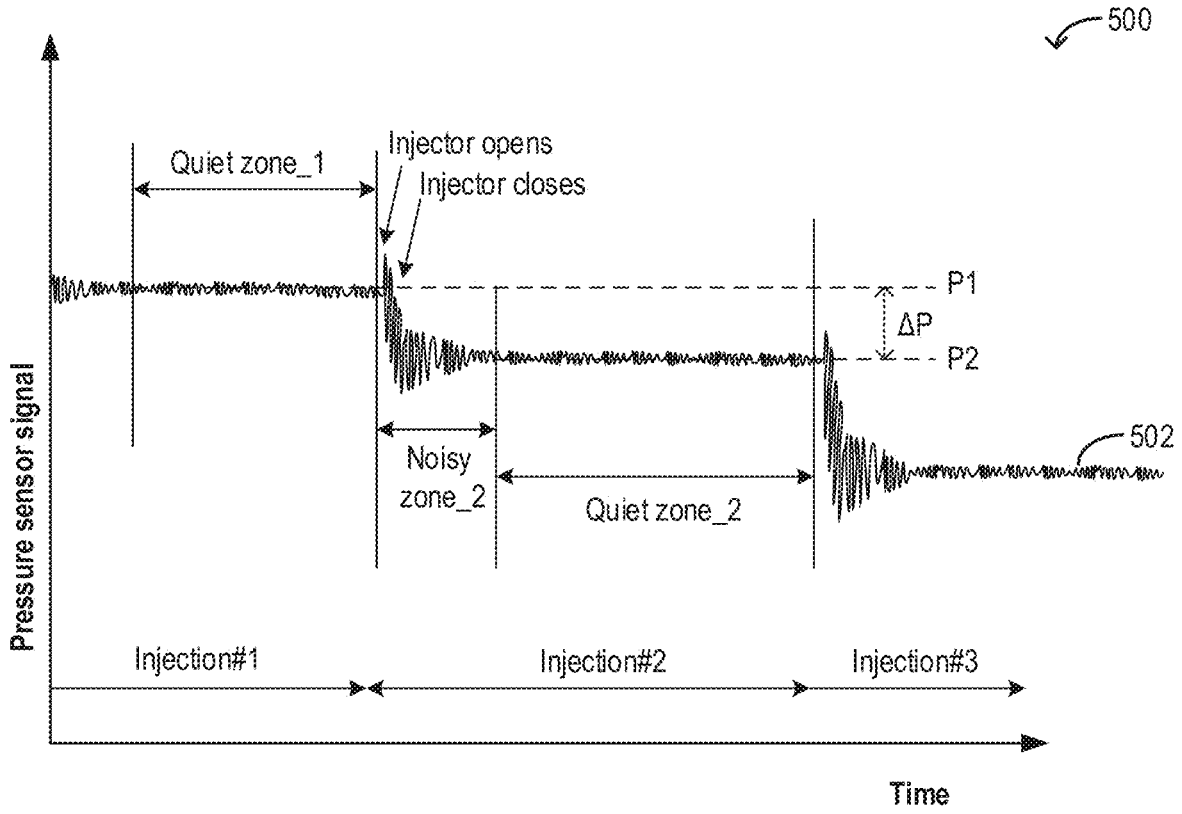
FIG. 5 depicts another example time/angle segment of an injection event over which a portion of fuel rail pressure samples are rejected, and another portion of fuel rail samples are averaged for injection volume estimation.

FIG. 5 shows another depiction of selection of FRP samples for injection pressure and fuel mass estimation. Map 500 depicts a (raw) signal generated by a fuel rail pressure sensor along the y-axis at plot 502, over time along the x-axis. Samples are collected at 1 msec intervals.

A portion of 3 consecutive injection events are depicted. The injection events occur in different cylinders and via distinct injectors. For each injection event, a noisy zone and quiet zone is defined. The noisy zone includes a region of pressure sampling where the injector opens and closes, as well as a duration after injector closing where the pressure oscillates or rings. The quiet zone includes pressure samples for a given injection event outside of the noisy zone and before pressure sampling of a subsequent injection event.

For injection #1, samples collected outside of the corresponding quiet zone (quiet zone_1) are discarded and an average pressure P1 is determined for the samples collected in the quiet zone. For the immediately subsequent injection #2, samples collected in the noisy zone (noisy zone_2) are discarded and an average pressure P2 is determined for the samples collected in quiet zone_2. The change in pressure $\Delta P$ (corresponding to P1-P2).

If the samples collected in the noisy zones were also included, aliasing errors would have occurred. For example, the average pressure of injection #1 would have been P1', higher than P1. In addition, the average pressure for injection #2 would have been P2', resulting a larger deltaP. If the pressure were sampled during the pressure fluctuation, as apparent by inspection, one generally would not get a sample that represents the average pressure between injections. Instead the sampled pressure would bias the average falsely high or low.

In this way, Fuel Rail Pressure (FRP) data may be selectively collected for purposes of injector balancing outside regions the ringing zone of pressure samples. By discarding the samples in the injector ringing zone, the noise error contribution is reduced. The technical effect of relying on pressure data collected over most or all of a quiet zone of the injector, and averaging the collected data instead of relying on a single FRP sample between injections, is that the multiple FRP samples can be used to yield a lower noise, and thereby a more accurate FRP measurement. Also, by avoiding the FRP data collected in the ringing zone and averaging the data collected in the quiet zone, a more reliable estimate of average FRP for purposes of pressure feedback control and injector pulse-width measurement is provided. By improving injector accuracy and providing better balancing between injectors of all engine cylinders, engine fueling accuracy and overall engine performance is improved.

One example method for an engine comprises: for an injection event, averaging fuel rail pressure sampled after a delay since an end of injector closing; learning an injector fuel mass error based on the averaged fuel rail pressure; and adjusting subsequent engine fueling based on the learned injector fuel mass error. In the preceding example, additionally or optionally, the method further comprises, not including fuel rail pressure sampled within the delay since the end of the injection event in the averaging. In any or all of the preceding examples, additionally or optionally, the learned injector fuel mass error is for an engine fuel injector, and the method further comprises learning the injector fuel mass error for each engine fuel injector and estimating an average injector fuel mass error based on the injector error for each fuel injector, and wherein adjusting subsequent engine fueling includes adjusting fueling from each engine fuel injector based on the learned injector error for a given fuel injector relative to the average injector fuel mass error. In any or all of the preceding examples, additionally or optionally, the method further comprises, for the injection event, sampling fuel rail pressure from immediately before a start of injector opening. In any or all of the preceding examples, additionally or optionally, the injection event is a first injection event, the injector is a first injector coupled to a first cylinder, and wherein the sampling is continued until the start of injector opening for a second injector coupled to a second cylinder on a second injection event, the second cylinder immediately following the first cylinder in an engine firing order. In any or all of the preceding examples, additionally or optionally, the learning includes: estimating a difference between the averaged fuel rail pressure for the first injection event with an averaged fuel rail pressure for a third injection event immediately preceding the first injection event; estimating an actual injection volume for the first injection event based on the estimated difference; and learning the injector error based on a difference between the actual injection volume and a commanded injection volume, the commanded injection volume based on a pulse-width commanded to the first injector. In any or all of the preceding examples, additionally or optionally, the injector error is further based on each of a fuel bulk modulus, fuel density, and fuel rail volume. In any or all of the preceding examples, additionally or optionally, adjusting subsequent engine fueling includes updating an injector transfer function for the first injector. In any or all of the preceding examples, additionally or optionally, adjusting engine fueling includes updating a transfer function for each engine fuel injector based on the learned error to provide a common error for each fuel injector. In any or all of the preceding examples, additionally or optionally, the injection event is a direct injection event, and wherein the injector is a direct fuel injector.

Another example method for an engine, comprises: sampling fuel rail pressure from immediately before injector opening at a first injection event to immediately before injector opening at a second, immediately consecutive, injection event; averaging fuel rail pressure sampled after a delay since injector closing of the first injection event; and adjusting engine fueling as a function of injector error learned based on the averaged fuel rail pressure. In any or all of the preceding examples, additionally or optionally, fuel rail pressure sampled from immediately before the injector opening to the delay since injector closing of the first injection event is not included in the averaging. In any or all of the preceding examples, additionally or optionally, the learned injector error is a first learned injector error for a first injector fueling a first cylinder on the first injection event, the method further comprising learning a second learned injector error for a second injector fueling a second, different cylinder on a second, different injection event, and averaging the first and second learned injector error. In any or all of the preceding examples, additionally or optionally, the adjusting includes reducing a difference between the first and second learned injector error by adjusting a transfer function of the first injector as a function of a difference between the first learned injector error and the average error, and adjusting a transfer function of the second injector as a function of a difference between the second learned injector error and the average error. In any or all of the preceding examples, additionally or optionally, the method further comprises, learning the injector error for the first injector as a function of each of the averaged rail pressure, a fuel bulk modulus, a fuel density, and a fuel rail volume.

Another example engine system comprises: a first fuel injector for delivering fuel from a fuel rail to a first cylinder; a second fuel injector for delivering fuel from the fuel rail to a second cylinder; a third fuel injector for delivering fuel from the fuel rail to a third cylinder; a pressure sensor coupled to the fuel rail; and a controller with computer-readable instructions that when executed cause the controller to: sample fuel rail pressure at a frequency on a first injection event from first injector opening to second injector opening, and on a second injection event from the start of second injector opening to the start of third injector opening; estimate a first average injection pressure for the first injection event by averaging the fuel rail pressure sampled from a delay since first injector closing to the second injector opening; estimate a second average injection pressure for the second injection event by averaging the fuel rail pressure sampled from a delay since second injector closing to the third injector opening; learn second injector error based on a difference between the first and second average injection pressure; and adjust a transfer function of the second injector based on the learned second injector error. In the preceding example, additionally or optionally, fuel rail pressure sampled from first injector opening to the delay since first injector closing is not included in the averaging for the first injection event, and the fuel rail pressure sampled from second injector opening to the delay since second injector closing is not included in the averaging for the second injection event. In any or all of the preceding examples, additionally or optionally, the controller includes further instructions that cause the controller to estimate an average injector error based on the learned second injector error and adjust the transfer function of the first and third injector based on the average injector error. In any or all of the preceding examples, additionally or optionally, each of the first, second, and third injector is a direct fuel injector. In any or all of the preceding examples, additionally or optionally, the transfer function is adjusted to provide a common injector error for each of the first, second, and third injector.

In a further representation, the vehicle system is a hybrid electric vehicle system. In another further representation, a method for an engine includes: on a direct injection event for each engine direct fuel injector, averaging fuel rail pressure sampled after a delay since an end of closing of a corresponding injector; learning a fuel mass error for the corresponding injector based on the averaged fuel rail pressure; and adjusting a transfer function of each engine direct fuel injector based on the learned fuel mass error of the corresponding injector relative to an average fuel mass error of all engine direct fuel injectors.

In yet another representation, a method of balancing fuel injectors includes, estimating, for each direct fuel injector of an engine, a fuel mass error based on average fuel rail pressure sampled after a delay since an end of closing of the injector; estimating an average injector fuel mass error based on the fuel mass error of each direct fuel injector; and adjusting a fuel pulse commanded to each direct fuel injector based on a difference between the fuel mass error of the direct injector relative to the average injector error. In the preceding method, additionally or optionally, the adjusting is performed iteratively, and wherein after each iteration, the fuel mass error of each injector is closer to each other.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

for an injection event, averaging fuel rail pressure sampled after a delay since an end of injector closing, where the delay is a threshold duration based on a fuel rail pressure ringing decay;

learning an injector fuel mass error based on the averaged fuel rail pressure; and adjusting subsequent engine fueling based on the learned injector error.

2. The method of claim 1, further comprising not including fuel rail pressure sampled within the delay since the end of the injection event in the averaging.

3. The method of claim 1, wherein the learned injector fuel mass error is for an engine fuel injector, the method further comprising learning the injector fuel mass error for each engine fuel injector and estimating an average injector fuel mass error based on the injector fuel mass error for each fuel injector, and wherein adjusting subsequent engine fueling includes adjusting fueling from each engine fuel injector based on the learned injector fuel mass error for a given fuel injector relative to an average injector fuel mass error.

4. The method of claim 1, further comprising, for the injection event, sampling fuel rail pressure from immediately before a start of injector opening.

5. The method of claim 4, wherein the injection event is a first injection event, an injector is a first injector coupled to a first cylinder, and wherein the sampling is continued until a start of injector opening for a second injector coupled to a second cylinder on a second injection event, the second cylinder immediately following the first cylinder in an engine firing order.

6. The method of claim 5, wherein the learning includes:

estimating a difference between the averaged fuel rail pressure for the first injection event with an averaged fuel rail pressure for a third injection event immediately preceding the first injection event;

estimating an actual injection volume for the first injection event based on the estimated difference; and learning the injector fuel mass error based on a difference between the actual injection volume and a commanded injection volume, the commanded injection volume based on a pulse-width commanded to the first injector.

7. The method of claim 6, wherein the injector fuel mass error is further based on each of a fuel bulk modulus, a fuel density, and a fuel rail volume.

8. The method of claim 5, wherein adjusting subsequent engine fueling includes updating an injector transfer function for the first injector.

9. The method of claim 1, wherein adjusting the subsequent engine fueling includes updating a transfer function for each engine fuel injector based on the learned injector fuel mass error to provide a common error for each engine fuel injector.

10. The method of claim 1, wherein the injection event is a direct injection event, and wherein the injector is a direct fuel injector.

11. A method for an engine, comprising sampling fuel rail pressures from immediately before injector opening at a first injection event to immediately before injector opening at a second, immediately consecutive, injection event;

averaging a subset of the fuel rail pressures sampled, the subset comprising only the fuel rail pressure sampled after a delay since injector closing of the first injection event to immediately before the injector opening at the second injection event, where the delay is a threshold duration based on a fuel rail pressure ringing decay; and adjusting engine fueling as a function of injector fuel mass error learned based on the averaged subset of the fuel rail pressure.

12. The method of claim 11, wherein the fuel rail pressures sampled from immediately before the injector opening to the delay since injector closing of the first injection event is not included in the averaging of the subset.

13. The method of claim 11, wherein the learned injector fuel mass error is a first learned injector fuel mass error for a first injector fueling a first cylinder on the first injection event, the method further comprising learning a second learned injector fuel mass error for a second injector fueling a second, different cylinder on a second, different injection event, and averaging the first and second learned injector fuel mass errors.

14. The method of claim 13, wherein the adjusting includes reducing a difference between the first and second learned injector fuel mass errors by adjusting a transfer function of the first injector as a function of a difference between the first learned injector fuel mass error and an average injector fuel mass error, and adjusting a transfer function of the second injector as a function of a difference between the second learned injector fuel mass error and the average injector fuel mass error.

15. The method of claim 13, further comprising learning the first injector fuel mass error for the first injector as a function of each of the averaged subset of the fuel rail pressure, a fuel bulk modulus, a fuel density, and a fuel rail volume.

16. An engine system, comprising:

a first fuel injector for delivering fuel from a fuel rail to a first cylinder;

a second fuel injector for delivering fuel from the fuel rail to a second cylinder;

a third fuel injector for delivering fuel from the fuel rail to a third cylinder;

a pressure sensor coupled to the fuel rail; and a controller with computer-readable instructions that when executed cause the controller to:

sample fuel rail pressure at a frequency on a first injection event from first injector opening to second injector opening, and on a second injection event from the start of second injector opening to a start of third injector opening;

estimate a first average injection pressure for the first injection event by averaging the fuel rail pressure sampled from a delay since first injector closing to the second injector opening, wherein the delay is a threshold duration based on a fuel rail pressure ringing decay;

estimate a second average injection pressure for the second injection event by averaging the fuel rail pressure sampled from a delay since second injector closing to the third injector opening;

learn a fuel mass error of the second fuel injector based on a difference between the first and second average injection pressures; and adjust a transfer function of the second fuel injector based on the learned fuel mass error of the second fuel injector.

17. The system of claim 16, wherein fuel rail pressure sampled from the first injector opening to the delay since the first injector closing is not included in the averaging for the first injection event, and the fuel rail pressure sampled from the second injector opening to the delay since the second injector closing is not included in the averaging for the second injection event.

18. The system of claim 16, wherein the controller includes further instructions that cause the controller to estimate an average injector fuel mass error based on the learned fuel mass error of the second fuel injector and adjust a transfer function of the first fuel injector and the third fuel injector based on the average injector fuel mass error.

19. The system of claim 16, wherein each of the first fuel injector, the second fuel injector, and the third fuel injector is a direct fuel injector.

20. The system of claim 16, wherein the transfer function of the second fuel injector is adjusted to provide a common injector fuel mass error for each of the first fuel injector, the second fuel injector, and the third fuel injector.

* * * * *